United States Patent [19]

Larsen et al.

[11] 4,389,955

[45] Jun. 28, 1983

[54] THREAD HOLDING FINGER FOR BOBBIN WINDING MECHANISM OF A SEWING MACHINE

[75] Inventors: Robert H. Larsen, Middletown, N.J.; Anthony Giaimo, Staten Island, N.Y.

[73] Assignee: The Singer Company, Stamford, Conn.

[21] Appl. No.: 265,506

[22] Filed: May 20, 1981

[51] Int. Cl.[3] ..... D05B 59/00

[52] U.S. Cl. ..... 112/184; 112/279

[58] Field of Search ..... 112/181, 184, 228, 229, 112/231, 279

[56] References Cited

U.S. PATENT DOCUMENTS

| | | | |
|---|---|---|---|
| 3,407,760 | 10/1968 | Ketterer | 112/184 |
| 3,693,565 | 9/1972 | Ketterer | 112/184 |
| 3,693,566 | 9/1972 | Ketterer | 112/184 |
| 4,259,914 | 4/1981 | Johnson | 112/184 |
| 4,326,474 | 4/1982 | Zylbert | 112/184 |

*Primary Examiner*—Wm. Carter Reynolds

*Attorney, Agent, or Firm*—William V. Ebs; Robert E. Smith; Edward L. Bell

[57] ABSTRACT

A thread engageable finger for guiding needle thread into a thread receiving slot on the bobbin case of a sewing machine, as a seized loop of the thread is moved about the bobbin case by a looptaker, is provided along a thread engaging edge with a predetermined curved contour effective to delay movement of the thread along said edge until the introduction of thread into the bobbin case slot as required for bobbin winding is assured.

7 Claims, 14 Drawing Figures

Fig.4
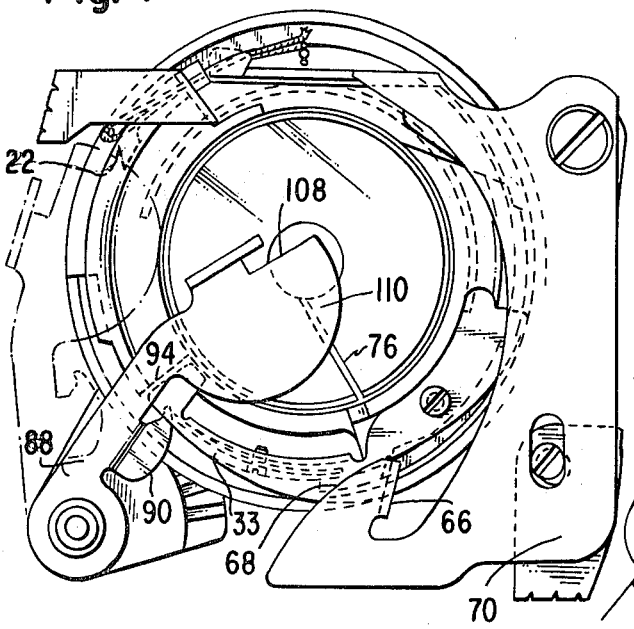
Fig.5
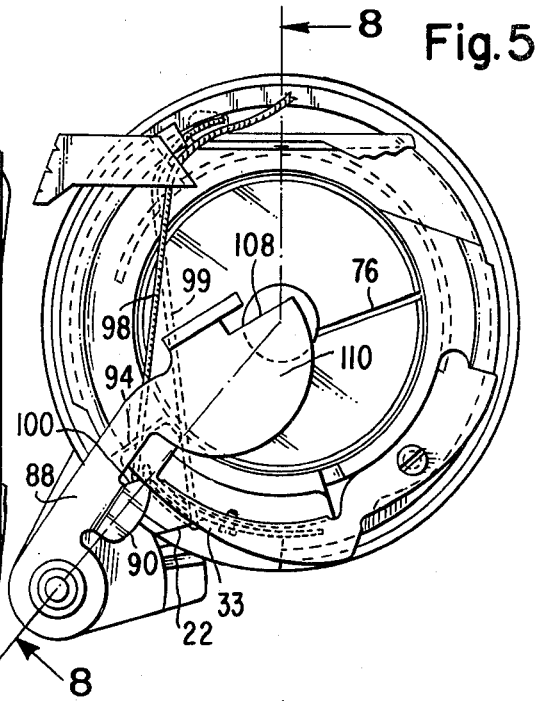
Fig.6
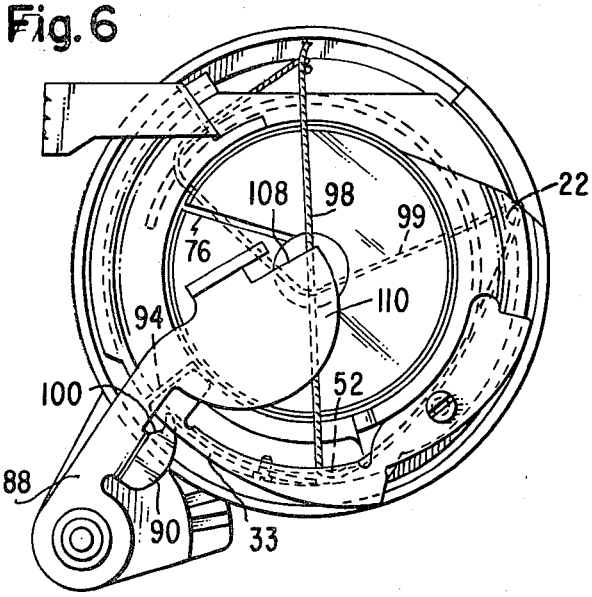
Fig.7
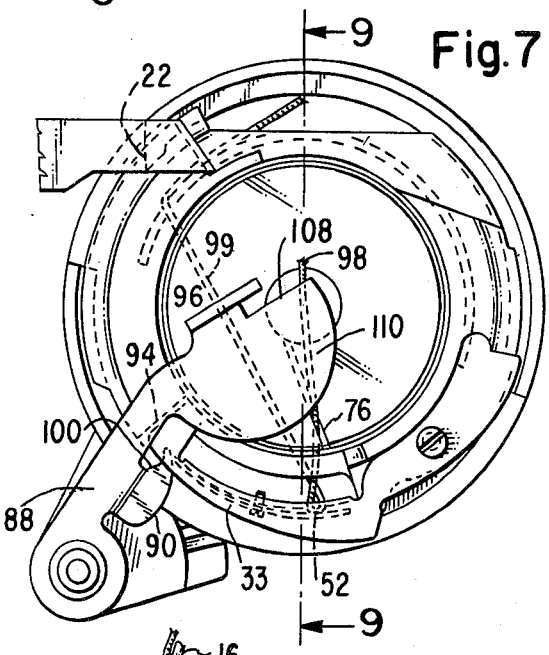
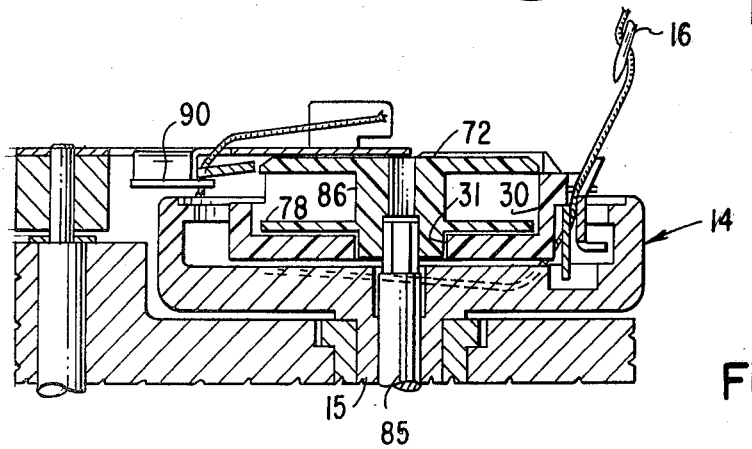
Fig.8

Fig.9
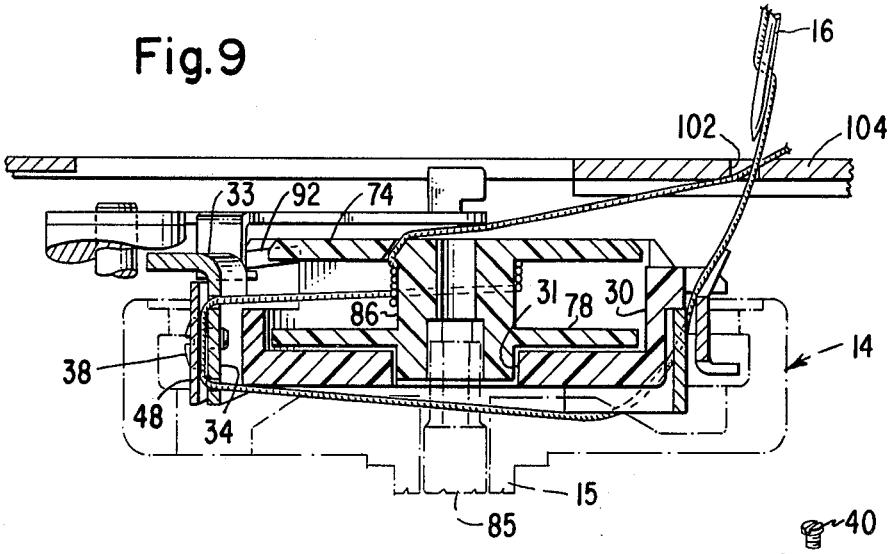
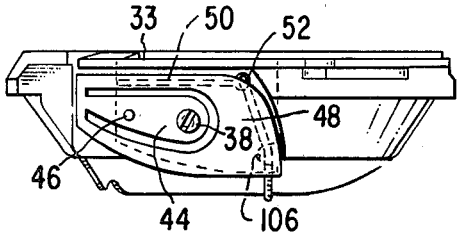
Fig.10
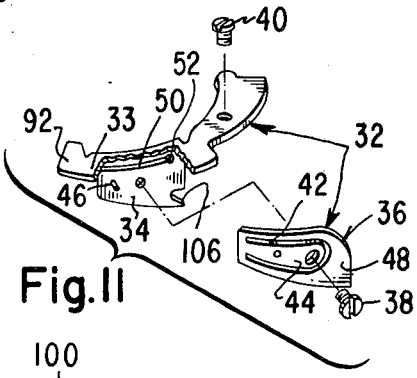
Fig.11
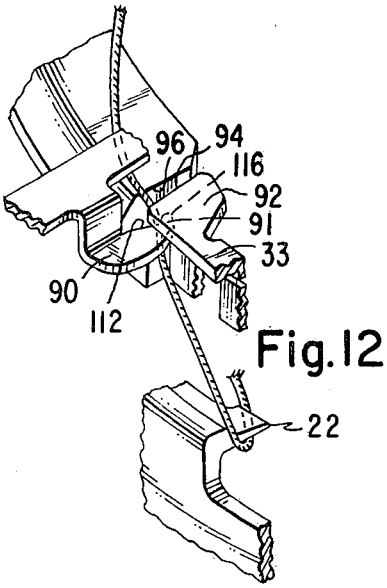
Fig.12
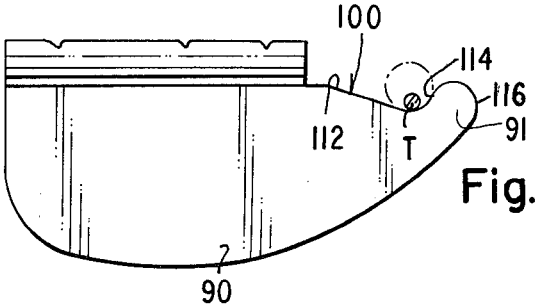
Fig.13
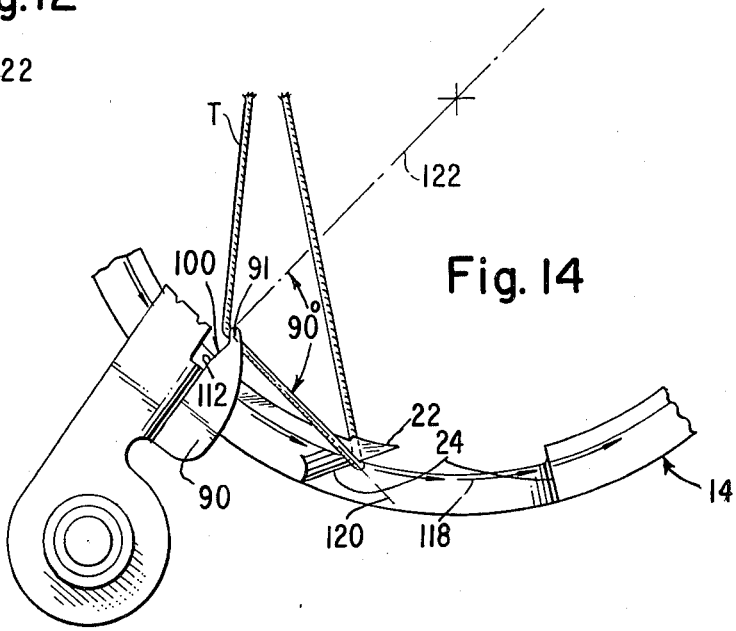
Fig. 14

THREAD HOLDING FINGER FOR BOBBIN WINDING MECHANISM OF A SEWING MACHINE

BACKGROUND OF THE INVENTION

1. Field of the Invention

The invention is directed to an arrangement for introducing needle thread which is to be wound on the bobbin of a lockstitch sewing machine into a bobbin case slot leading to a thread tensioning device.

2. Description of the Prior Art

U.S. Pat. No. 3,693,566 of The Singer Company issued Sept. 26, 1972 discloses bobbin replenishing mechanism for a lockstitch sewing machine. Such mechanism includes a thread engageable finger that is provided for the purpose of guiding needle thread, which is to be wound upon a bobbin, into a bobbin case slot leading to a thread tensioning device. The thread is moved along the finger and into the mouth of the slot as a seized loop of the thread is moved about the bobbin case by the loop taker, and is supposed to be moved down the slot into the tensioning device by continued motion of the looptaker. However, it sometimes happens that the thread is pulled out of the mouth of the slot after leaving the finger and is caused to move across the slot. As a consequence, the thread fails to enter the tensioning device and the winding of thread onto the bobbin is prevented.

It is an object of the present invention to render bobbin replenishing mechanism effective to so control the movement of needle thread carried by a looptaker as to assure the full introduction of the thread into a bobbin case slot leading to a thread tensioning device and passage of the thread into the tensioning device.

It is another object of the invention to provide bobbin winding mechanism with a thread guiding finger which is effective to hold a limb of a loop of needle thread carried by a looptaker around a bobbin case until movement of the thread by way of a bobbin case slot into a thread tensioning device is assured.

Other objects and advantages of the invention will become apparent during a reading of the specification taken in connection with the accompanying drawings.

SUMMARY OF THE INVENTION

In accordance with the invention, bobbin replenishing mechanism of the kind disclosed in U.S. Pat. No. 3,693,566 is provided with a thread guiding and holding finger which when positioned for bobbin winding renders certain the introduction of a limb of a seized loop of thread on a looptaker into a bobbin case slot, and movement therefrom to thread tensioning means. The thread engageable edge of the finger is formed at least in part with a predetermined curvature which delays the movement of the thread toward the slot to prevent the thread from leaving the finger before the thread is carried by the looptaker to a point defined by the intersection of a thread holding point in the looptaker and a line drawn substantially perpendicularly to a radius extending from the axis of rotation of the looptaker to the end of the finger adjacent the bobbin case slot. The thread by being so delayed on the finger is prevented from being pulled out of the mouth of the slot and can only move through the slot as required for the winding of thread on the bobbin.

DESCRIPTION OF THE DRAWINGS

FIGS. 4, 5, 6 and 7 are top plan views showing the thread engageable finger as disposed for bobbin winding, and showing the looptaker in various positions during initial stages of the bobbin winding operation;

FIG. 8 is a sectional view taken on the plane of the line 8—8 of FIG. 5;

FIG. 9 is a sectional view taken on the plane of the line 9—9 of FIG. 7;

FIG. 10 is an elevational view of the bobbin case illustrating the needle thread in a thread tensioning device during a bobbin winding operation;

FIG. 11 is an exploded perspective view of the thread tensioning device;

FIG. 12 is a perspective view showing a fragment of the bobbin case and illustrating the function of the thread engageable finger of the invention;

FIG. 13 is an enlarged plan view of the finger;

FIG. 14 is a somewhat diagrammatic view illustrating the geometry of the thread engageable finger and looptaker.

DESCRIPTION OF THE INVENTION

Figure 1:
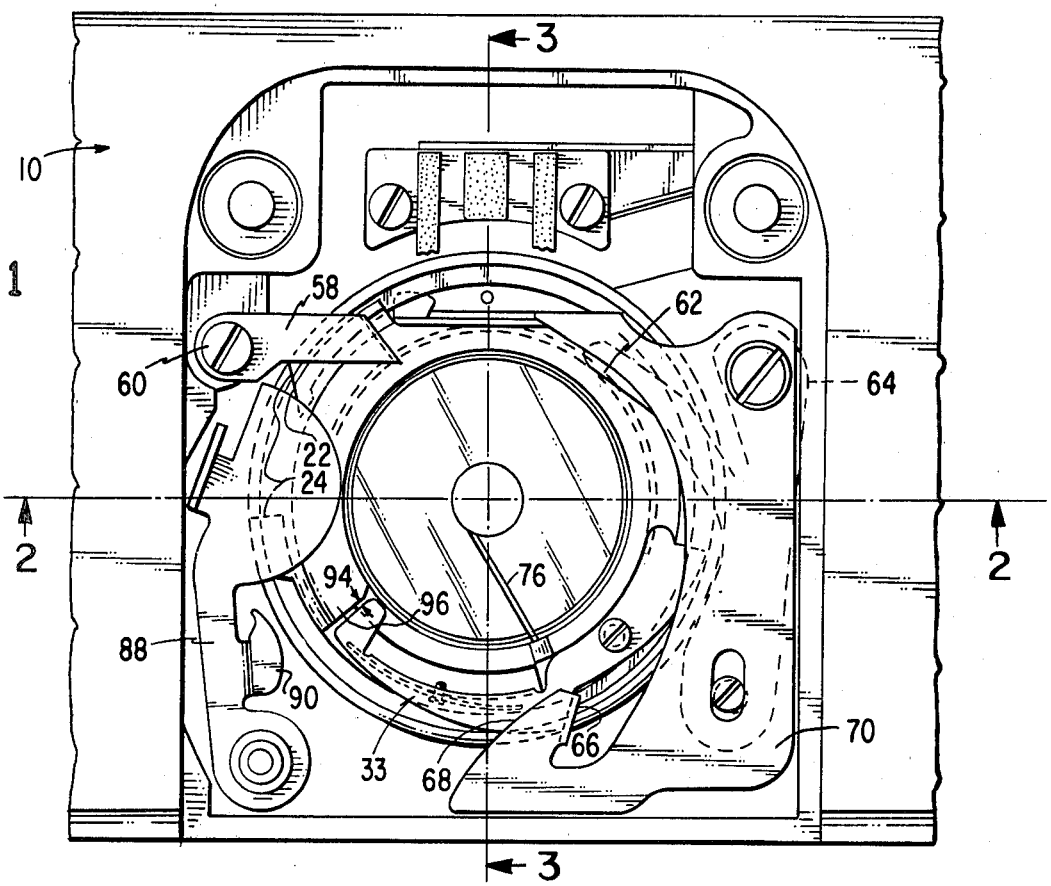
FIG. 1 is a top plan view showing a looptaker in the bed of a sewing machine together with mechanism for constraining a bobbin case in the looptaker, and with a thread engageable finger according to the invention as disposed by a control arm during a sewing operation.
Figure 2:
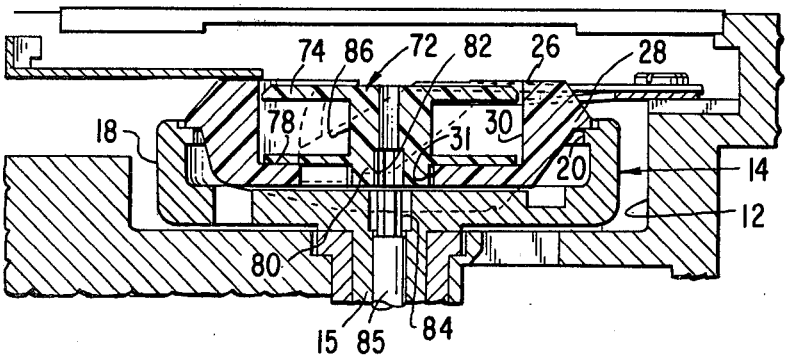
FIG. 2 is a fragmentary sectional view taken on the plane of the line 2—2 of FIG. 1.

Referring to the drawings, reference character 10 designates a portion of a sewing machine bed including an upwardly open cavity 12 wherein looptaker 14 is accommodated for rotation by a hollow shaft 15. The looptaker cooperates with an endwise reciprocatory needle 16 to provide for the formation of lockstitches in a manner well understood in the art, and as fully described in U.S. Pat. No. 3,693,565 of Stanley J. Ketterer for "Lockstitch Loop Takers for Sewing Machines" issued Sept. 26, 1972.

As shown, the looptaker 14 has an upwardly open cup-shaped form. The looptaker includes a rim 18, and an annular inwardly projecting shoulder 20 which forms a needle thread loop seizing beak 22 at a lateral opening 24.

A bobbin case 26 is supported within the cup-shaped form of the looptaker where a bobbin case bearing flange 28 rests upon looptaker shoulder 20. The bobbin case is formed with an upwardly open bobbin accommodating cavity 30 through the bottom of which a large central aperture 31 extends.

The bobbin case 26 carries a thread tensioning device 32 including a support arm 33, a downturned arm 34, and a thread tensioning spring 36 which is secured by a screw 38 to the downturned arm 34. A screw 40 extending through support arm 33 secures the tensioning device to the bobbin case. The spring 36 is formed with a slot 42 in the form of a U-shaped loop separating a tongue 44 through which the screw 38 and a locating pin 46 on arm 34 pass. Surrounding the tongue 44 is another spring blade portion 48 which frictionally engages thread in the device 32 against the downturned arm 34 to apply tension to the thread. The downturned arm 34 is formed with a thread entry slot 50 which as shown in FIGS. 10 and 11, terminates in an eyelet 52 for directing thread to the spring blade portion 48 of spring 36.

A member 58 which rests in a shallow recess in the bobbin case flange 28 and is secured to the machine bed by a screw 60 serves to restrain rotation of the bobbin case 26 in the machine bed 10. A hold down spring arm 62 which extends from a bed mounted base plate 64, and a rotation restraining lip 66 on an arm 68 extending from a bed mounted base plate 70 provide additional restraint for the bobbin case.

A bobbin 72 is freely rotatable within the bobbin accommodating cavity 30 of the bobbin case 26. The bobbin includes a top plange 74 formed with an outwardly extending slot 76 skewed slightly from a true radial position on the top flange. The bobbin further includes a bottom flange 78 having a depending boss 80 which fits into the central aperture 31 of the bobbin case. Boss 80 is formed with a non-circular aperture 82 to match the non-circular extremity 84 of a driving spindle 85 located in hollow looptaker shaft 15. Between the flanges 74 and 78 of the bobbin a plain cylindrical hub 86 is provided. The spindle is part of a bobbin thread replenishing mechanism as disclosed in U.S. Pat. No. 3,693,566 of Stanley J. Ketterer for "Bobbin Thread Replenishing Mechanism for Sewing Machines" issued Apr. 23, 1971. Such mechanism includes the control arm 88 which, as explained in said patent is movable between a position apart from the bobbin case (FIG. 1), and a position over the bobbin case and bobbin as shown in FIGS. 4, 5, 6, 7, 8 and 9. As further explained in U.S. Pat. No. 3,693,566, when the arm 88 is disposed over the bobbin case and bobbin, the spindle 85 is raised to enter bobbin aperture 82, and the bobbin is then rotated with the looptaker to provide for the winding of needle thread T on the bobbin. In the position of control arm 88 for bobbin winding, a finger 90 thereon is disposed to project a tip end portion 91 under an end portion 92 of tensioning device support arm 33 to a location adjacent a slot 94 between the said end portion and a shoulder 96 on the bobbin case.

Figure 3:
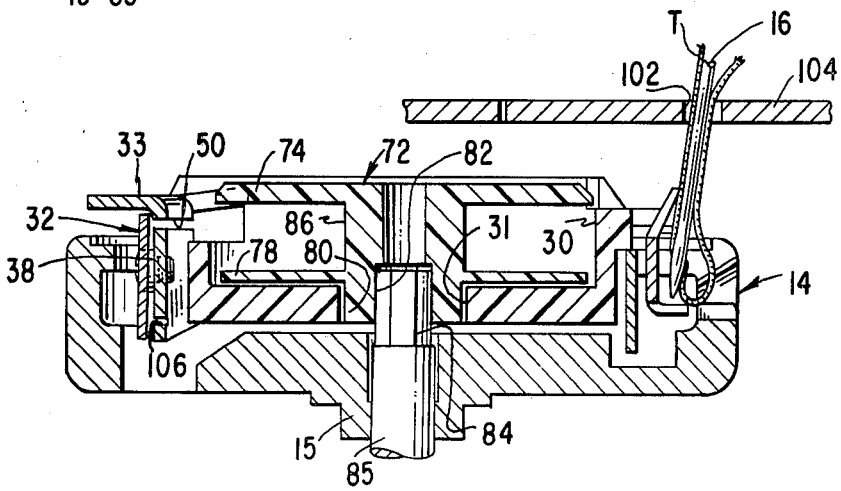
FIG. 3 is a fragmentary sectional view taken through the looptaker on the plane of the line 3—3 of FIG. 1, and showing needle thread which is to be wound on a bobbin at the time of seizure by the looptaker.

During a bobbin winding operation, needle thread T presented by the needle 16 as in FIG. 3 for seizure by the beak 22 of looptaker 14, after having been picked up by beak 22, is moved as a loop by the looptaker about the bobbin case (FIG. 4) toward the finger 90, and one limb 98 of the loop is caused to move over the bobbin case, whereas the other limb 99 is moved under the bobbin case (FIG. 5). As may be seen in FIG. 5, limb 98 is caused to engage edge 100 of finger 90. Thread limb 98 is guided into slot 94 by the finger 90. As will be explained more fully hereinafter, edge 100 of the finger is contoured to delay movement of the thread thereon, and so prevent any possibility of the thread being prematurely moved off the finger, pulled out of the mouth of slot 94 and looped over the end portion 92 of support arm 32 with a consequent failure of the thread to pass through the slot 94. After thread limb 98 has entered slot 94, continued rotation of the looptaker results in the thread being moved into the position shown in FIG. 6 in thread eyelet 52 in downturned arm 34 of the tensioning device 32. The needle thread at this stage will have been introduced between downturned arm 34 and spring blade portion 48 of the tensioning device.

As rotation of the looptaker continues, the loop of needle thread is drawn off the looptaker beak 22 and, depending upon the position in which the bobbin happened to be when the spindle 85 was elevated, slot 76 in the top flange of the bobbin is moved as in FIG. 7 past the free end of the needle thread loop extending from eyelet 52 over the bobbin 72 and to the needle aperture 102 in a throat plate 104. With continued rotation of the looptaker, the limb of needle thread which enters the bobbin through the slot is wrapped around the bobbin hub 86. As wrapping of the thread begins, slack is dissipated and the thread is drawn into a groove 106 in the thread tensioning device. The slot 76 is so skewed that the limb of thread extending to the throat plate is moved back and forth across an edge 108 formed on the blade 110 of the control arm 88. An abrading action of the thread on the edge 108 severs the thread after a number of rotations of the bobbin. The free end of the needle thread may then be withdrawn and discarded. Continued rotation of the bobbin serves to wind replenishment thread thereon for later use as bobbin thread in the formation of lockstitches. The replenishment thread is drawn into the bobbin in a path as indicated in FIG. 9 that proceeds from the path of reciprocation of the needle downwardly between the bobbin case 26 and looptaker base, between the thread tensioning spring blade 48 and downturned arm 34 of the tensioning device 32, and then into the bobbin.

As noted hereinbefore, finger 90 has edge 100 contoured to delay movement of the thread along it. The finger is best shown in FIG. 13 where the edge may be seen as including a linear portion 112 and a concave curved portion 114 extending smoothly from the linear portion 112 almost to the tip end 116 of the finger. The linear portion 112 leads thread on the finger into portion 114 which is formed with a curvature that is predetermined to render the finger effective to hold thread until the thread T is carried by the looptaker beak 22 to a point defined by the intersection of the circular path 118 of the thread on the beak 22 of the looptaker, and a line 120 drawn substantially perpendicular to a radius 122 extending from the axis of the looptaker to the tip end portion 91 of finger 90 under support arm 33. Premature movement of the thread off the finger, followed by outward movement of the thread across the top of the finger, and then inward movement of the thread across the support arm 32 and slot 94 such as may occur with a finger as contoured in U.S. Pat. No. 3,693,566 is thereby prevented, and the introduction of the thread into the slot is assured. Preferably the curved portion 114 of the finger is circular and tangent to the straight line portion 112 as clearly shown in FIG. 13. The circular form is not only particularly effective, but is also readily producible with conventional machining techniques.

It is to be understood that the present disclosure relates to a preferred embodiment of the invention which is for purposes of illustration only and is not to be construed as a limitation of the invention. Numerous alterations and modifications of the structure herein will suggest themselves to those skilled in the art, and all such modifications, and alterations which do not depart from the spirit and scope of the invention are intended to be included within the scope of the appended claims.

I claim:

1. In a lockstitch sewing machine, a cup-shaped circular moving looptaker including a peripheral rim formed with a thread seizing beak, a non-rotatable bobbin case supported in the looptaker, a rotatable bobbin within the bobbin case, an endwise reciprocable needle movable into a position for presenting a loop of needle thread to the looptaker beak for seizure, a thread tensioning device carried by the bobbin case and including an arm forming a thread entering slot for said device with a shoulder on the bobbin case, a finger disposable in a position wherein an end portion projects under the arm of the tensioning device and serves to guide a limb of a seized loop of needle thread into said slot thereby providing for the passage of the thread into the tensioning device, thread pick up means on the bobbin, and means for rotating the bobbin to cause the bobbin to pick up and wind thread extending through the tensioning device onto the bobbin, said finger having a thread engageable edge formed at least in part with a predetermined curvature extending to the said end portion of the finger and along which the movement of thread toward the slot is delayed to prevent the thread from leaving the finger at least until the thread is carried in said throat to a point which is substantially defined by the intersection of the path of thread on the looptaker beak and a line perpendicular to a radius extending from the looptaker axis to the finger.

2. The combination of claim 1 wherein said curvature extends concavely in the finger.

3. The combination of claim 1 wherein said curvature extends concavely to an end portion of the finger adjacent the said slot.

4. The combination of claim 1 wherein the thread engaging edge of the finger includes a linearly extending portion.

5. The combination of claim 1 wherein the thread engaging edge of the finger includes an end part adjacent the said slot, and includes a linearly extending portion for leading thread into the said predetermined curvature.

6. The combination of claim 5 wherein the curved portion is circular.

7. The combination of claim 6 wherein the circular curved portion of the finger is tangent to the linear portion.

* * * * *